US005106666A

United States Patent [19]

Fitzgerald et al.

[11] Patent Number: 5,106,666

[45] Date of Patent: Apr. 21, 1992

[54] HIGH STRENGTH PARTICLEBOARD HAVING REINFORCING STRIPS

[75] Inventors: Jack D. Fitzgerald; George W. Doege, Jr., both of Franklin, Va.

[73] Assignee: Union Camp Corporation, Wayne, N.J.

[21] Appl. No.: 503,184

[22] Filed: Apr. 2, 1990

[51] Int. Cl.[5] ..... B44C 1/26; B44C 1/28; B44C 3/12

[52] U.S. Cl. ..... 428/67; 428/105; 428/106; 428/326; 428/537.1; 52/312; 144/332; 156/293; 156/298

[58] Field of Search ..... 428/67, 105, 106, 326, 428/537.1, 167, 172; 52/312, 313; 156/293, 298; 144/332, 348, 330

[56] References Cited

U.S. PATENT DOCUMENTS

| | | | |
|---|---|---|---|
| 19,174 | 1/1858 | Shedaker | 52/313 |
| 1,954,754 | 4/1934 | Hartzell | 428/106 |
| 2,751,946 | 6/1956 | Gramelspacher | 52/313 |
| 3,578,523 | 5/1971 | Ohse | 156/164 |
| 3,652,372 | 3/1972 | Klazkin | 156/298 |
| 3,837,634 | 9/1974 | Cobb | 428/114 |
| 3,887,415 | 6/1975 | Elmendorf | 156/298 |
| 4,122,236 | 10/1978 | Holman | 428/453 |
| 4,361,612 | 11/1982 | Shaner et al. | 428/106 |

FOREIGN PATENT DOCUMENTS

| | | | |
|---|---|---|---|
| 572646 | 3/1959 | Canada | 156/298 |
| 70934 | 6/1981 | Japan . | |

OTHER PUBLICATIONS

ASTM D 1554-78, American National Standard, "Standard Definitions of Terms Relating to Wood--Based Fiber and Particle Bound Materials".

*Primary Examiner*—Ellis P. Robinson
*Assistant Examiner*—Nasser Ahmad
*Attorney, Agent, or Firm*—William K. Wissing

[57] ABSTRACT

Composite particleboards and methods for manufacturing these particleboards are provided in which a plurality of discrete lignocellulosic particles are bonded together to form a core and then hot pressed with a plurality of reinforced strips having a thickness of less than about 6.4 mm for improving the bending strength of the particleboard structure. Both the modulus of rupture and modulus of elasticity of particleboard materials are demonstrated to have been improved significantly.

4 Claims, 2 Drawing Sheets

HIGH STRENGTH PARTICLEBOARD HAVING REINFORCING STRIPS

FIELD OF THE INVENTION

This invention relates to particleboard fabrication methods, and more particularly, to means for reinforcing particleboard for improved resistance to tensile loads. Such materials find wide application as structural members in the manufacture of furniture and home building products.

BACKGROUND OF THE INVENTION

Particleboard is a generic term for a panel-like material manufactured from lignocellulosic materials, preferably wood, primarily in the form of discrete pieces or particles, as distinguished from fibers. The discrete particles are bonded together preferably with a synthetic resin or other suitable binder under heat and pressure in a hot press. Such procedures produce an interparticle bond in which the binder, or glue, bonds together the discrete lignocellulosic particles. Particleboards can be pressed into their final form by extrusion or through the use of multi-platen, hot press devices. See generally, the discussion found at ASTM D 1554-78, American National Standard, "Standard Definitions of Terms Relating to Wood-Based Fiber and Particle Bound Materials"; U.S. Pat. Nos. 4,361,612; 4,122,236 and 3,578,523 which are hereby incorporated by reference.

Conventional three-quarter inch particleboard panels typically have the following properties.

| | |
|---|---|
| density | $46.2^{lb}/ft^3$ |
| modulus of rupture | 2685 psi |
| modulus of elasticity | 500,081 psi |

Although such boards are satisfactory for many applications, there is a current need for a particleboard having a higher modulus of rupture for specific end-use applications, such as furniture manufacturing and flooring. Such high strength particleboard ideally would retain about the same density as conventional products in order to meet current engineering and weight requirements for these industries.

SUMMARY OF THE INVENTION

This invention provides composite particleboards which include a core comprising a plurality of discrete lignocellulosic particles bonded together. The core is reinforced with a plurality of strips having a thickness of less than about 6.4 mm disposed on at least a planar surface of the core for improving at least the bending strength of the composite particleboard.

This invention also provides a method of manufacturing composite particleboard by first providing an unpressed core including a plurality of discrete lignocellulosic particles bonded together. The method further includes the step of disposing a plurality of reinforcing strips having a thickness of less than about 6.4 mm on a planar surface of the core and then hot pressing the reinforcing strips and the core to produce a substantially planar finish to the particleboard.

Accordingly, the composite particleboard produced by this invention has a higher modulus of rupture than unreinforced particleboard structures. The composite particleboard exhibits as much as a three-fold increase in the modulus of rupture while maintaining at least 90% of the density of the particleboard core in a hot-pressed condition. Such a product is ideally suited to furniture and construction applications for use under tensile loads.

BRIEF DESCRIPTION OF THE DRAWINGS

The accompanying drawings illustrate preferred embodiments of the invention for presenting a practical application of the principles thereof, and in which.

DETAILED DESCRIPTION OF THE INVENTION

Particleboards are provided by this invention which include a core made up of lignocellulosic particles which are bonded together. The particleboard includes a plurality of reinforcing strips having a thickness of less than about 6.4 mm disposed on at least a planar surface of the core for improving at least the bending strength of the particleboard.

In a more preferred embodiment of the invention, a composite particleboard is provided which includes a core made up of discrete lignocellulosic particles and comprising at least two overlapping reinforcing strips having a thickness of less than about 3.2 mm which are adhesively adhered and then heat-fused to the core. The strips are adhered to at least a planar surface of the particleboard exposed to a tensile load, for improving at least the bending strength of the particleboard. In this embodiment, the particleboard has an overall density of not less than 90% of the density of the core when the core is in a hot pressed condition.

This invention also provides a method of manufacturing a composite particleboard comprising providing an unpressed core including a plurality of discrete lignocellulosic particles bonded together. The method includes a step of adhesively attaching a plurality of overlapping reinforcing wooden strips to the core. These strips have a thickness of less than about 3.2 mm and a grain which is substantially parallel to the length of the strips. The strips are applied to a planar surface of the particleboard which is exposed to a tensile bending load. The method also includes the step of hot pressing the reinforcing strips and the core to fuse the reinforcing strips substantially into the core to provide a substantially planar surface finish and an overall density of not less than 90% of the density of the core when the core is in a hot pressed condition.

Figure 1:
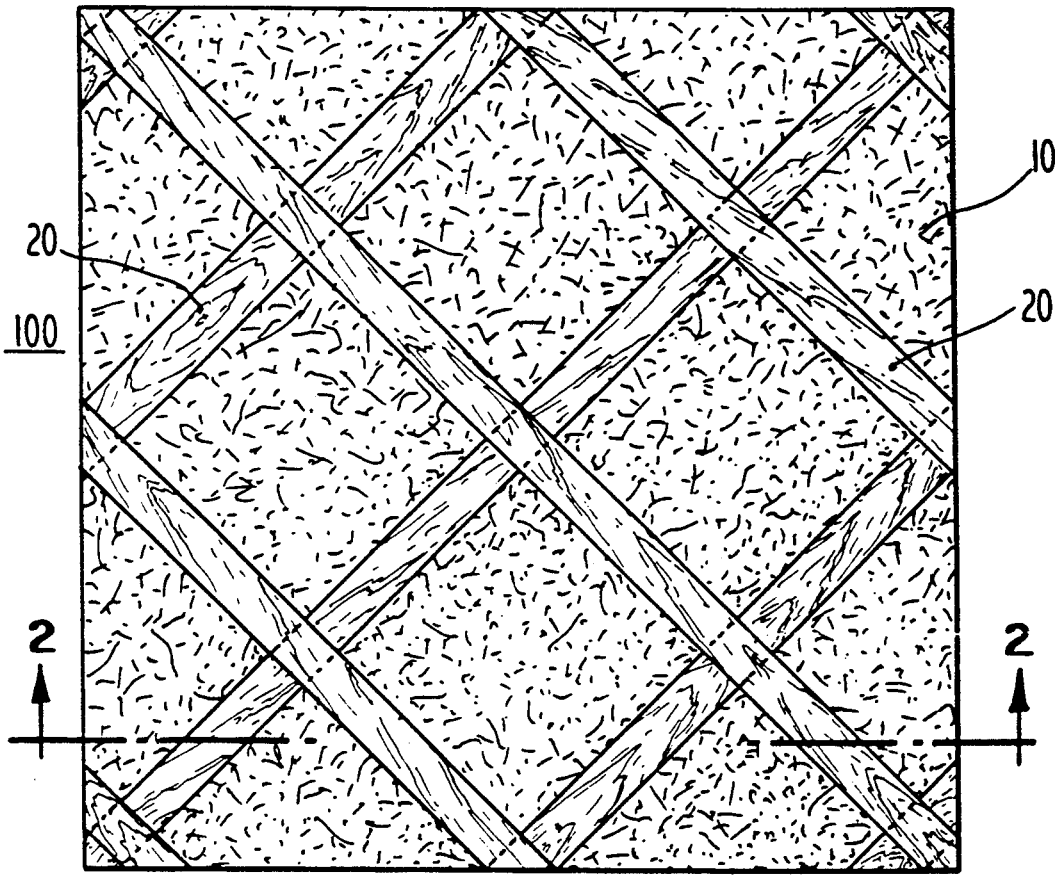
FIG. 1: is a plan view of a preferred particleboard structure having strips of veneer disposed in a grid pattern.
Figure 2:
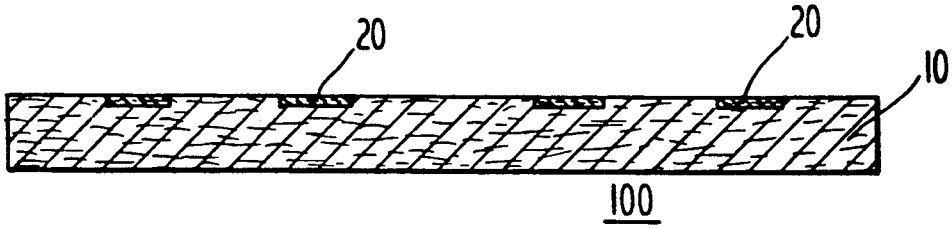
FIG. 2: is a cross-sectional view of the particleboard of FIG. 1 taken through line 2—2.

With reference to FIG. 1, there is described a particleboard 100 having a core 10 and symmetrical lattice of reinforcing strips 20. The reinforcing strips 20 preferably have a thickness of less than about 6.4 mm, more preferably less about 3.2 mm, and a width of less than about 15.25 cm, preferably less than about 8 cm. The symmetrical lattice can be formed with a dry glue line on the backing side of the veneer strips. The lattice is then pressed onto the particleboard mat in a hot press, employing a preferred single step pressing to form a unified composite.

Figure 3:
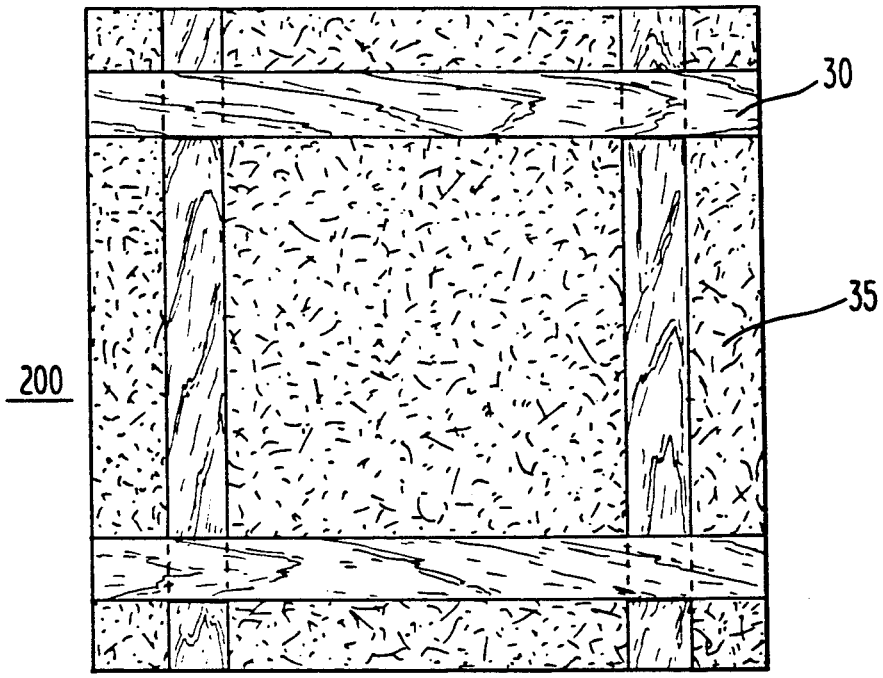
FIG. 3: is a plan view of an alternative particleboard structure suitable for furniture components, illustrating a square grid pattern.
Figure 4:
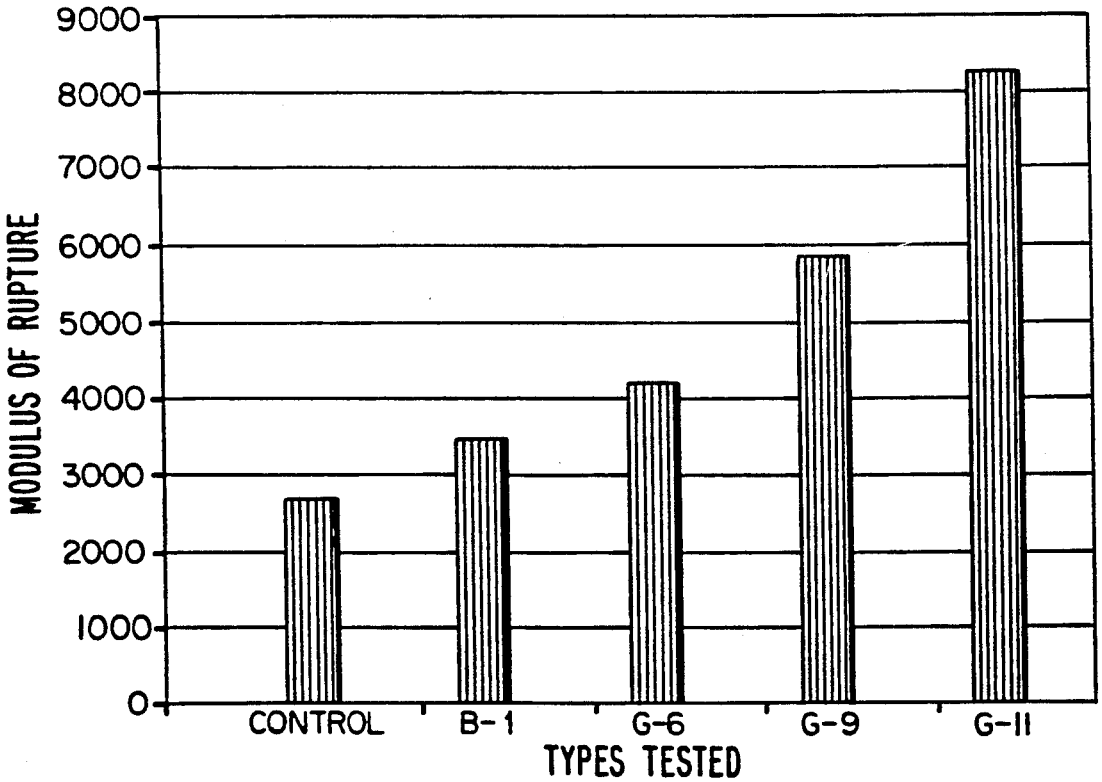
FIG. 4: is a graph depicting the modulus of rupture versus types of particleboards tested, showing the impact of various reinforcing strip structures.

Referring now to the embodiment of FIG. 3, there is shown a furniture component board 200 comprising a square lattice having a core 35 and reinforcing veneer strips 30. Preferably this particleboard has outer dimensions of 61 cm×61 cm with a 2.38 cm thickness. In a preferred embodiment 7.62 cm×61 cm×0.1 cm poplar wood veneer is glued to the planar surface of the board, prior to hot pressing. In the preferred embodiments of this invention, the grids of reinforcing wood strips 30 or 20 are preferably only applied to the tension side of the particleboard.

A preferred method for manufacturing a reinforced, three-ply particleboard from a furnish comprising predominately southern yellow pine will now be described. The face finish is made from pine planar shavings and sawdust that are mechanically refined into small particles. After refining, the face furnish is screened to proper size with oversized material being refined. The core furnish is manufactured from a mixture of pine planar shavings, hardwood shavings, and sawdust. Core stock is reduced in size, preferably by means of a knife mill. After milling, the materials are screened to size before drying.

Thereafter, each furnish is dried in a dryer by means of hot air. The face furnish is dried to a preferred moisture content of about 6% by weight, and the core furnish is dried to a preferred moisture content of about 4% by weight, each based upon oven dry finish. Storage of the dried furnish ahead of the blender is preferable for a smooth flow of material through the resin blenders.

The preferred binder composition for the face furnish comprises about 93 parts by weight of a catalyzed, buffered urea-formaldehyde resin base composition having a mol ratio of formaldehyde to urea of about 11:10 and having about 65 weight % resin solids in an aqueous medium and wax emulsion at about 48% wax solids. This binder composition is applied to the face furnish in a resin blender in an amount sufficient to supply about 7 to 9 percent resin solids based upon the oven dry face furnish.

The preferred binder composition is applied to the core furnish in a resin blender in an amount sufficient to supply about 7 to 9 by weight percent of resin solids based upon oven dry core furnish.

Thereafter, the core and face furnishes are formed into a three-ply mat on a caul plate by known air-classifying processes. By weight, the mat is ideally composed of about 60% face material and 40% core material. A preferred grid of 7.62 cm wide×0.318 cm thickness wood strips are then glued to the surface of the particleboard mat prior to hot-pressing. Alternatively, a dry glue line can be deposited on the veneer grid or the mat, such that when exposed to the hot-press temperatures, the glue adheres the strips of the grid to the core.

The wood mats and grid of veneer reinforcing strips on the caul plates are compressed, preferably in a single step, under a pressure in the range of about 500 to 700 pounds per square inch (not measured, but believed to be nearer 700 psi), while the platens of the press are heated to about 325°-340° F. For three-quarter inch, 1.9 cm, particleboard, the press time is about 4-5 minutes and the total press cycle time (including loading and unloading the press) is about 5½-6½ minutes, slightly longer press times for 1⅛ inch board, and slightly less for thinner boards. After hot pressing, the panels, typically 1.52 m×4.88 m, are separated and cooled prior to storage. The individual panels are then sanded to very tight tolerances and cut to customer requirements.

The following table illustrates several examples prepared with a standard particleboard core and the strips of poplar veneer of this invention.

TABLE I

| Panel | Density | Modulus of Rupture | Modulus of Elasticity | Modulus of Thickness |
|---|---|---|---|---|
| Control Board (No Lattice Grid) | 46.2#/ft$^3$ | 2685 psi | 500,081 psi | ¾" (1.9 cm) |
| B-1 Thin Poplar (0.055", 1.40 mm thickness) | 44.4#/ft$^3$ | 3479 psi | 521,361 psi | ¾" (1.9 cm) |
| G-6 Thin Poplar (0.054" 1.37 mm thickness) | 43.6#/ft$^3$ | 4194 psi | 620,354 psi | ¾" (1.9 cm) |
| G-9 Thin Poplar (0.055", 1.40 mm thickness) | 43.4#/ft$^3$ | 5859 psi | 620,572 psi | ¾" (1.9 cm) |
| G-11 Thick Poplar (0.125", 3.12 mm thickness) | 43.4#/ft$^3$ | 8240 psi | 816,800 psi | ¾" (1.9 cm) |

It is noted that poplar strips having dimensions of 0.125" (3.12 mm) thick and 2" (5.1 cm) in width provided the best combination of modulus of rupture and elasticity for a three-quarter inch panel thickness. This increase in bending strength and mechanical properties was obtained with about 6% decrease in density.

The foregoing establishes that increased bending properties can be provided to particleboard by incorporating relatively thin sections of wood veneer in a hot pressing operation. The veneer reinforcing strips are preferably incorporated into a tensile loaded surface of the particleboard and can be pressed into the surface of the particleboard so that a flat surface finish and appropriate density can be achieved for high quality furniture making. Although various embodiments have been illustrated, this was for the purpose of describing, but not limiting, the invention. Various modifications, which will become apparent to one skilled in the art, are within the scope of the invention described in the attached claims.

What is claimed is:

1. A composite particleboard having a core including a plurality of discrete lignocellulosic particles bonded together, said particleboard comprising a plurality of wooden reinforcing strips having a thickness of less than about 6.4 mm which are adhesively adhered and heat fused to said core to form a substantially planar surface finish and to form a symmetrical lattice of overlapping, reinforcing strips on at least a planar surface of said particleboard exposed to a tensile load for improving at least the bending strength of said particle board;

said particleboard having an overall density of not less than 90% of the density of said core when said core is in a hot pressed condition.

2. A method of manufacturing a composite particleboard comprising:

providing an unpressed core including a plurality of discrete lignocellulosic particles bonded together;

adhesively attaching a plurality of reinforcing wooden strips to said core, said strips having a thickness of less than 6.4 mm and a grain which is substantially parallel to the length of said strips, said strips disposed onto a planar surface of said particleboard which is exposed to a tensile bending load to form a symmetrical lattice of overlapping, reinforcing strips;

hot pressing said symmetrical lattice of overlapping, reinforcing strips and said core to fuse said symmetrical lattice substantially into said core to provide a substantially planar surface finish and an overall particleboard density of not less than 90% of the density of said core when said core is in a hot pressed condition.

3. The particleboard of claim 1 wherein said overlapping, reinforcing strips in said symmetrical lattice are substantially perpendicular to each other.

4. The method of claim 2 wherein said overlapping, reinforcing strips in said symmetrical lattice are disposed onto said planar surface substantially perpendicular to each other.

* * * * *